United States Patent [19]

Reid

[11] 4,266,688

[45] May 12, 1981

[54] EASY ACCESS TAB FOR VACUUM PACKED PRODUCTS

[75] Inventor: Jeremy T. Reid, Oakville, Canada

[73] Assignee: The Continental Group, Inc., New York, N.Y.

[21] Appl. No.: 103,871

[22] Filed: Dec. 14, 1979

[51] Int. Cl.[3] ..... B65D 41/32

[52] U.S. Cl. ..... 220/273; 220/269

[58] Field of Search ..... 220/269–273

[56] References Cited

U.S. PATENT DOCUMENTS

| | | | |
|---|---|---|---|
| 3,176,872 | 4/1965 | Zundel | 220/270 |
| 3,225,957 | 12/1965 | Huth | 220/273 |
| 3,397,812 | 8/1968 | Batchelar | 220/273 |
| 3,938,696 | 2/1976 | Herbst | 220/273 |

*Primary Examiner*—George T. Hall

*Attorney, Agent, or Firm*—Charles E. Brown

[57] ABSTRACT

This invention relates to an end unit of the easy opening type particularly adapted for use in a vacuum packed container. The end panel of the end unit is provided with doming which permits the associated tab to be slightly lifted before a rupturing force is applied with the tab. The particular shape of the dome provides for the necessary doming without an undue stressing of the already scored end panel.

7 Claims, 13 Drawing Figures

FIG. 4 PRIOR ART
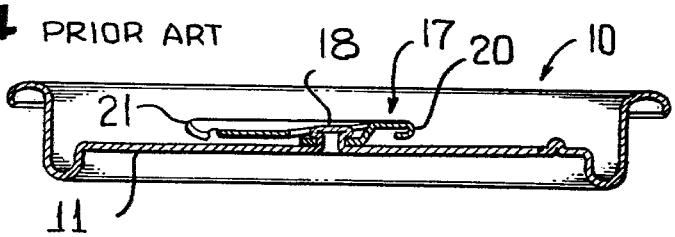
FIG. 5 PRIOR ART
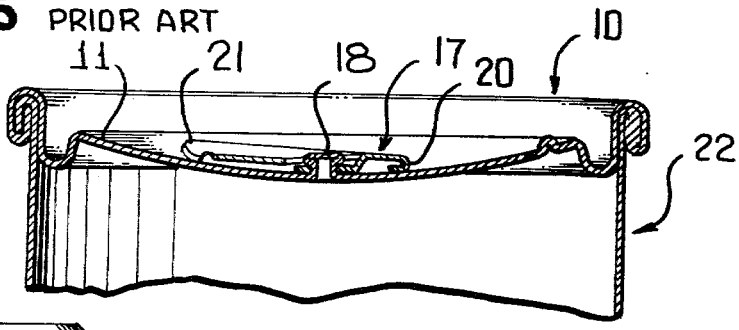
FIG. 6
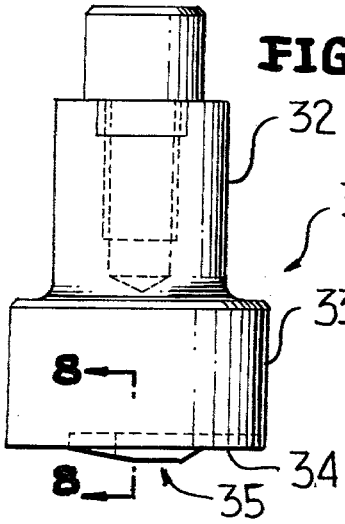
FIG. 8
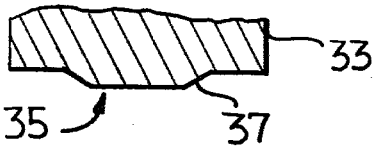
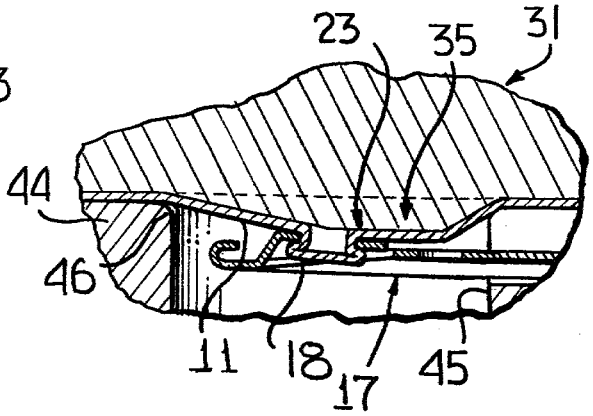
FIG. 9
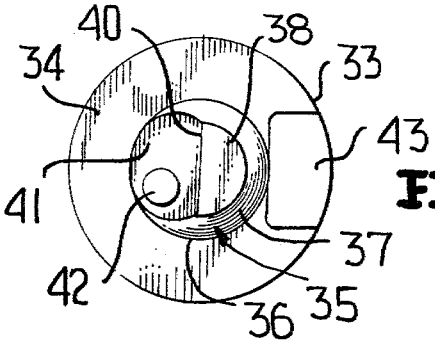
FIG. 7

EASY ACCESS TAB FOR VACUUM PACKED PRODUCTS

This invention relates in general to new and useful improvements in easy opening containers, and more particularly to an easy opening container wherein the product is vacuum packed and the container panel carrying the easy opening feature is inwardly bowed due to the pressure differential.

In the usual construction of easy opening containers, there is a scored area which defines a displaceable panel portion. There is also a rivet which secures to the panel a tab which, when one end is lifted, serves to effect rupture of the scoring and displacement of the displaceable panel portion. In particular, there is in usage an easy opening end unit wherein the end panel thereof has formed therein in offset relation to the center thereof suitable scoring defining a displaceable panel portion. At the general center of the end panel there is a rivet which is integrally formed and which secures a tab to the end panel with the force applying end of the tab overlying the displaceable panel portion and the tab extending generally away from the displaceable panel portion.

In the ordinary construction of such end unit, the tab is disposed closely adjacent the end panel and only a minimum space is provided between the lift end of the tab and the end panel. This space may be increased slightly by inwardly indenting the end panel underlying the lift end of the tab. On the other hand, the pressure applying end of the tab is still disposed substantially in contacting relation with the displaceable panel portion.

While the foregoing easy opening end unit is satisfactory for normal packaging conditions including instances where the container is internally pressurized, when the same end unit is utilized on a vacuum packed container, the pressure differential results in an axially inward bowing of the end panel with the result that the tab has both ends thereof firmly engaging the panel and making it extremely difficult for one to engage the lift end to effect the necessary pivoting of the tab. Further, since the pressure applying end of the tab is already in pressure contact with the displaceable panel portion, the tab is either already loaded or immediately assumes a load so that the full lifting force is required on the tab at the time one initially engages the tab. This invention has to do with modifying the mounting of the tab to eliminate this condition.

In the past, tabs have been offset with respect to their respective end panels by doming the end panel in the rivet area so that the rivet is set up relative to the general plane of the end panel. However, normally the rivet is disposed within the displaceable panel portion and thus doming of the central portion of the end panel has no undesirable result. A typical example of such doming is found in the U.S. Pat. to Zundel, No. 3,176,872, granted Apr. 6, 1965. A similar doming is shown in the U.S. Pat. to Batchelar, No. 3,397,812, granted Aug. 20, 1968.

It was thought that the undue initial lifting force required on the end unit of this invention could be readily resolved by means of a conventional doming. It was found, however, that when the doming was effected in the conventional manner there was an undue stressing of the end panel along the lines of scoring and the net result was unsatisfactory.

Specifically it has been found that the geometry of the dome must be adequate to keep the tab nose spaced from the end panel under the forces imposed by the pressure differential. Accordingly, in accordance with this invention, it is proposed to provide a doming of the end panel in the area of the rivet, but where the dome is a full dome only on that side of the rivet remote from the displaceable panel portion and wherein the dome is minimized in the area of scoring. Basically, in the longitudinal direction of the tab, away from the displaceable panel portion, the doming is that of a truncated cone, whereas from the center of the rivet toward the displaceable panel portion the doming is that of a straight line slope in section. This results in a minimal stressing of the end unit in the scored area.

It has been found that the required doming of the end panel can be accomplished by way of several different tooling and that the tooling does not have to match the dome per se, but that when the end panel is properly supported the metal may be domed by a slight drawing operation. Therefore, while it is preferred that the tooling include a projection on a punch having a sloped face which generally defines the sloping surface of the doming, the tool may have an abrupt edge and the necessary slope on the dome be formed merely by stretching of the metal.

With the above and other objects in view that will hereinafter appear, the nature of the invention will be more clearly understood by reference to the following detailed description, the appended claims, and the several views illustrated in the accompanying drawings.

IN THE DRAWINGS

FIG. 4 is a sectional view similar to FIG. 2, but showing the same end unit without doming.

FIG. 5 is a sectional view similar to FIG. 3 of the conventional end unit applied to a container and the container being vacuum packed.

FIG. 6 is a side elevational view of a punch developed for forming the doming shown in FIGS. 2 and 3.

FIG. 7 is a bottom plan view of the punch, and shows the configuration thereof.

FIG. 8 is a fragmentary sectional view taken generally along the line 8—8 of FIG. 6, and shows the general outline of the doming 90° from the illustration of FIG. 6.

FIG. 9 is an enlarged fragmentary schematic sectional view showing the cooperation of the punch with a die member in the doming of an end unit.

Figure 1:
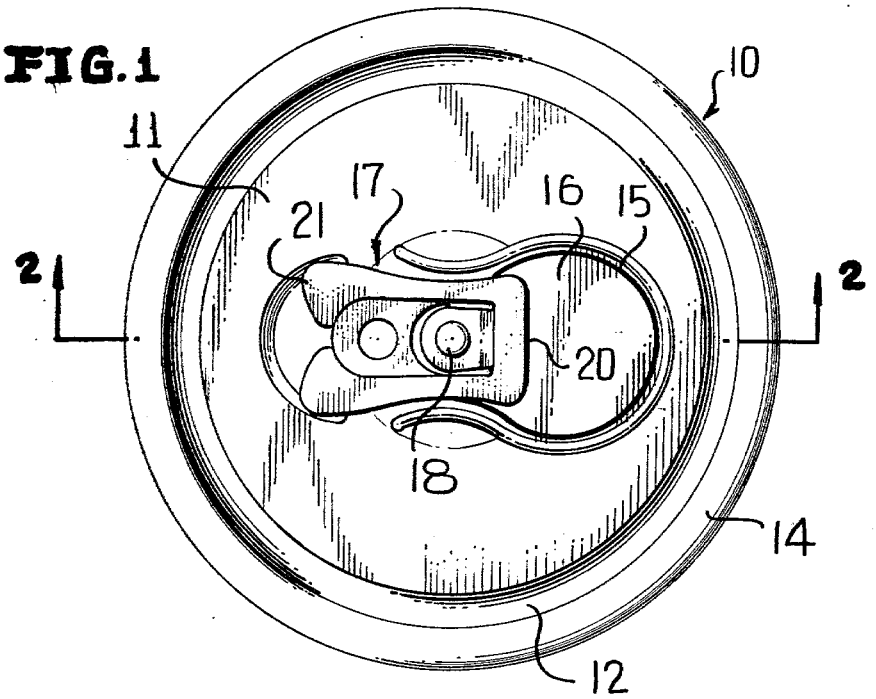
FIG. 1 is a plan view of an end unit formed in accordance with this invention.
Figure 2:
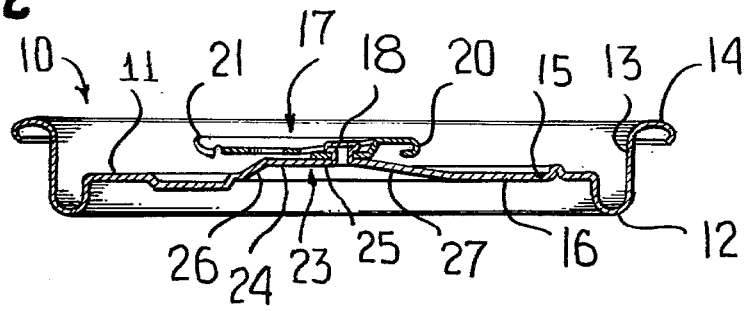
FIG. 2 is a vertical sectional view longitudinally of the tab through the end unit of FIG. 1, generally along the line 2—2.

Referring now to the drawings in detail, it will be seen that there is illustrated in FIG. 1 a container end unit generally identified by the numeral 10. The container end unit is a typical example of the environment of this invention and includes an end panel 11 defined by a shock absorbing bead 12 and surrounded by an upstanding chuck wall 13 and the usual seaming flange or curl 14. The end unit 10 is of an easy opening type and has in offset relation to the center thereof scoring including a score line 15 which defines a displaceable panel portion 16 which is intended to be inwardly depressed to define a dispensing opening while remaining hinged to the remainder of the end panel 11.

Rupture of the end panel 11 along the score line 15 is effected by means of a tab generally identified by the numeral 17. The tab 17 is secured to the end panel 11 by a rivet 18 formed from the material of the end panel 11 and being integral therewith. The tab 17 has a force applying end 20 and a lifting end 21. When the lifting end of the tab 17 is elevated or moved away from the end panel 11, the force applying end or nose 20 engages the displaceable panel portion 16 and serves to initiate rupture of the end panel along the score line 15. As the tab 17 is continued to be lifted, rupture along the score line 15 progresses and the displaceable panel portion 16 is displaced into the interior of an associated container to a fully open position.

Reference is now made to the prior art illustration of FIGS. 4 and 5. It will be seen in FIG. 4 that when the easy opening end unit 10 is formed in the customary manner, the tab 17 loosely overlies the end panel 11 and the lifting end 21 thereof may be lifted a slight distance before the nose 20 is disposed in pressure engagement with the underlying panel portion. However, when that same end unit is part of a container, generally identified by the numeral 22, and the container 22 is vacuum packed, as in FIG. 5, it will be seen that the pressure differential on opposite sides of the end panel 11 results in an axially inward bowing of the end panel as shown in FIG. 5. This results in the nose 20 of the tab coming into pressure engagement with the underlying panel portion. At the same time, the lifting end 21 also closely approaches or engages the underlying part of the end panel 11. The net result is that when one engages one's finger or fingernail beneath the lifting end 21 of the tab, the nose 20 is already in pressure contact with the underlying panel portion and there is immediately required the necessary lifting force to effect rupture of the end panel along the score line 15. This is highly undesirable in that many people do not have sufficient strength to apply this initial lifting force at a time when they cannot obtain good engagement with the tab.

In accordance with this invention, the conventional end unit is modified by doming the same to provide a dome generally identified by the numeral 23. The dome 23, instead of being of the conventional configuration, is configurated differently on the side of the rivet away from the displaceable panel portion 16 than it is on the side adjacent the displaceable panel portion 16. Most specifically, the dome 23 on the side of the rivet 18 remote from the displaceable panel portion 16 has a configuration of one-half of a truncated cone. This dome part is identified by the numeral 24 and includes a flat end panel 25 which has a semicircular outline with a center generally corresponding to the axis of the rivet 18. The flat panel end panel portion 24 is joined to the end panel 11 by a relatively sharp angle sloping wall 26 which, in a particular tool set, has an angle of slope on the order of 22° 30′.

The other half of the dome 23 is in the form of a shallow sloping flat surface 27 which joins the semicircular dome part along a straight line and it gradually slopes back to the original plane of the end panel 11.

Figure 3:
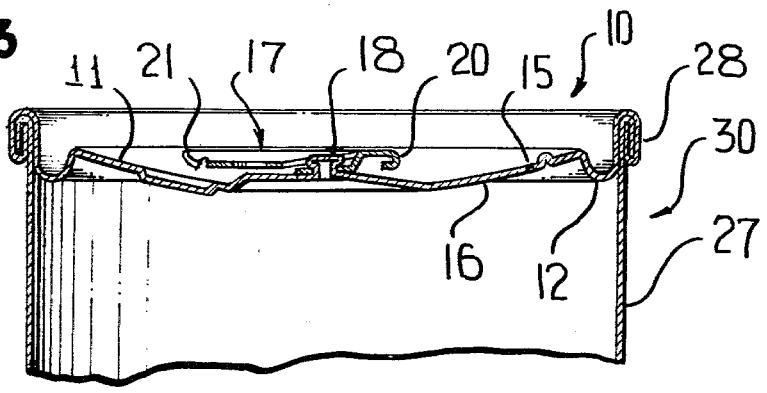
FIG. 3 is a sectional view of the end unit similar to FIG. 2, but showing the end unit applied to a container body and the container being vacuum packed.

With reference to FIG. 3, it will be seen that when the end panel 10 is secured to a container body 27 by way of, for example, a conventional double seam 28, and the resultant container, generally identified by the numeral 30, is vacuum packed, the end panel 16 will axially inwardly bow in the same general manner as shown with respect to the prior art end unit of FIG. 5. However, the nose 20 of the tab 17 remains spaced from the underlying displaceable panel portion 16 while the lifting end 21 also remains slightly above the underlying panel portion so as to facilitate the engagement of the tab. The spacing is such that in a container of the beer and beaverage type there is approximately $\frac{1}{8}$ inch play in the tab. In other words, the lifting end of the tab 17 may be lifted on the order of $\frac{1}{8}$ inch before the nose comes into pressure contact with the underlying displaceable panel portion.

It has been found that in accordance with this invention if the end panel 11 is domed in the illustrated manner, there will be no premature rupture of the score 15. In the past when the same end unit 10 was domed with a conventional type of doming such as that suggested by the aforementioned Zundel patent, the scoring which is incorporated in the domed area was unduly stressed and frequently undersired rupture occurred. However, by providing the doming in two parts and making the second part of the doming in the form of a shallow slope, undue stressing of the end panel along the score line 15 is eliminated.

Referring now to FIGS. 6–8, it will be seen that there is illustrated a punch particularly constructed for use in doming the end unit 10. The punch is generally identified by the numeral 31 and includes an upper shank 32 which may be mounted in suitable tooling. The shank portion 32 terminates at its lower end in a body or head 33 which has a generally flat underface 34 from which a projection 35 projects. The projection 35, as is best shown in FIGS. 6–8, has a circular outline 36 where it meets the face 34. The projection 35 may be divided into two parts which include a first part 37 which is of a configuration of a truncated cone. The first part 37 includes an end face 38 which is disposed substantially parallel to the end face 34 and is simicircular in outline.

The second part of the projection 35 slopes from its intersection with the semicircular end 38 along a diametrical line 40 to the plane of the end face 34 along a flat sloping surface 41.

Where required, the sloping part 41 may have a longitudinal bore 42 formed therein for receiving a projection on the end panel of the end unit.

It is also to be noted that the end surface 34 of the punch body 33 is notched as at 43 to clear a downwardly directed projection on the end panel, such projection normally being in the form of a sink providing the necessary space under the lifting end of the tab to effect the lifting of the tab.

Referring now to FIG. 9 in particular, it will be seen that there is provided a die 44 which cooperates with the punch 31 for effecting the doming of the end panel. The die 44 has a bore 45 thereinto for receiving the rivet 18 and other projecting portions of the end panel 11 which may exist. The end unit is in an inverted positions and has received a respective tab. In the preferred embodiment of the invention, it is to be noted that the bore 45 is of a diameter less than that of the circular outline 36 of the projection so that the projection 36 cannot be fully telescoped within the bore 45. On the other hand, the shoulder defined by the intersection of the bore 45 and the surface of the die 44 is rounded so as to form a working surface in cooperation with the punch 31. The working surface is generally identified by the numeral 46. The rounded configuration of the working surface 46 permits the necessary projecting part of the projection 35 to enter into the bore 45 while not permitting the entire projection 35 to enter into the bore 45. Thus, the controlled doming of the end panel can be effected while setting a periphery of the resultant dome 23. The cross section of the dome 23 is one which provides for stability of the dome and which prevents everting of the dome. Further, because of the gradual slope of the part 11, the end panel in the vicinity of the scoring 15 is not unduly stressed and the necessary doming can be effected without cracking.

With particular reference to FIG. 6, it is to be understood that the projection 35 may have a circular outline with a diameter of 0.90 inch and the doming may be on the order of 0.057 inch. This doming permits sufficient doming of the rivet area for the application of the necessary offsetting of the tab without an undue restriction on the formation of the end unit.

Figure 10:
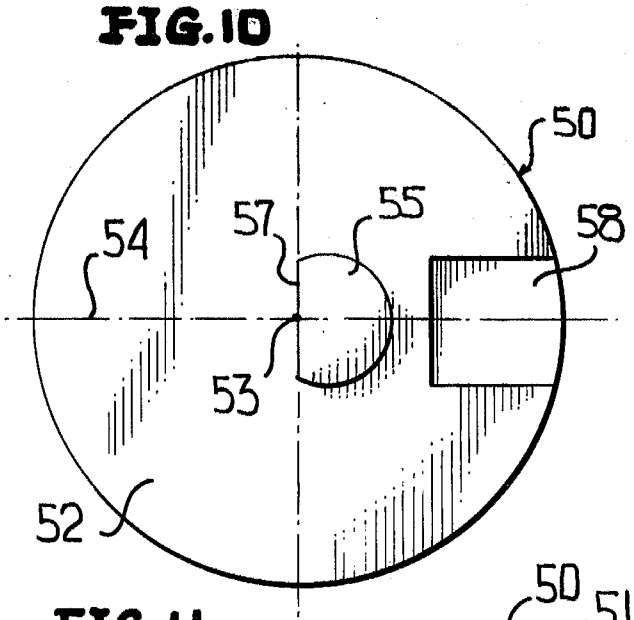
FIG. 10 is a bottom view of another form of punch which may be used instead of the punch of FIGS. 6-8.
Figure 11:
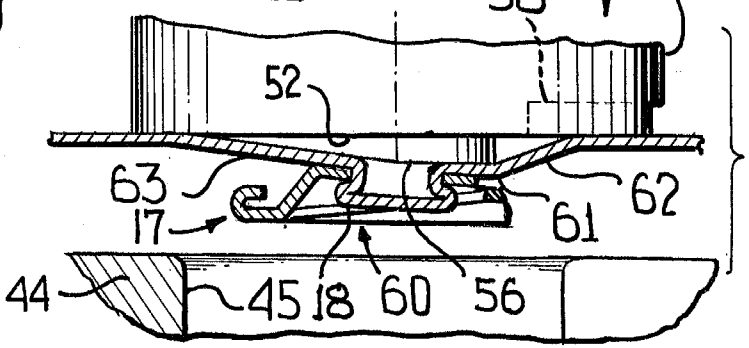
FIG. 11 is a vertical sectional view through the punch of FIG. 10, and shows the same cooperating with a die to effect the doming of a panel.

Although the punch 31 has been specifically provided to effect the desired doming, it has been found that other punch configurations will be likewise effective. Reference is now made to FIGS. 10 and 11 wherein another form of punch, generally identified by the numeral 50, is illustrated. The punch 50 includes a circular cross-sectional portion 51 which terminates in a flat end face 52. The end face 52 has a center 53 which, in use of the punch 50, is centered relative to the rivet 18. Depending from the end face 52 are centered on a transverse line 54 extending through the center 53 is a projection 55. The projection 55 is of a constant cross section and has a flat end face 56 (FIG. 11). It is to be noted that the projection 55 includes an end wall 57 which is disposed in alignment with the center 53 and that otherwise the projection 55 is of a generally semicircular outline although it could be part oval or part elliptical and thus elongated along the transverse line 54.

Also centered on the transverse line 54 and spaced from the projection 55 is a notch 58 which corresponds to the notch 43 and is provided for clearance relative to the recessed portion of the container end panel.

Referring specifically to FIG. 11, it will be seen that the punch 50 is illustrated in use in conjunction with the die 44 and that preferably, although not necessarily, the punch 50 is of a larger diameter than the opening 45 through the die. It will be seen that the projection 55 serves to provide a dome 60 on the container panel and that the high portion 61 of the dome corresponds generally in outline to the configuration of the projection 55. The metal of the container panel is stressed so that the portion thereof which normally underlies the handle portion of the pull tab 17 has a pronounced slope 62 while on the opposite side of the high portion 61 the dome 60 has a more gentle slope 63. This slope 63 provides the necessary clearance for the nose portion of the tab 17, permitting the nose portion to be depressed into engagement with the removable panel portion without interference.

Figure 12:
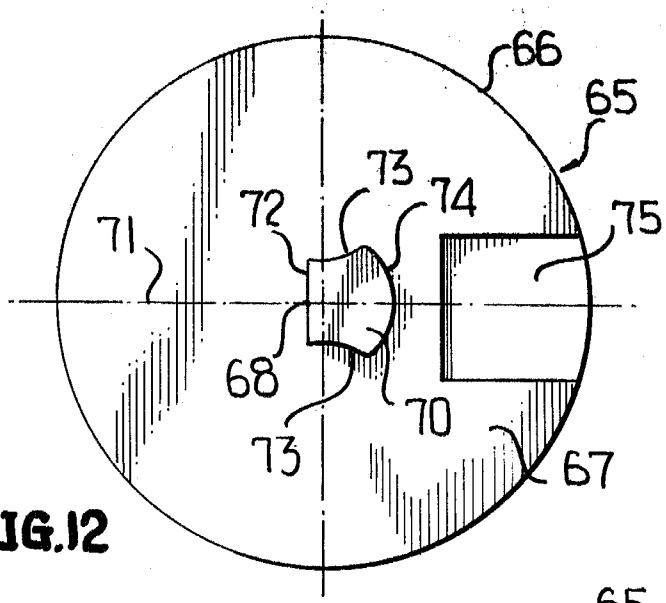
FIG. 12 is a bottom plan view of still another punch in accordance with this invention.
Figure 13:
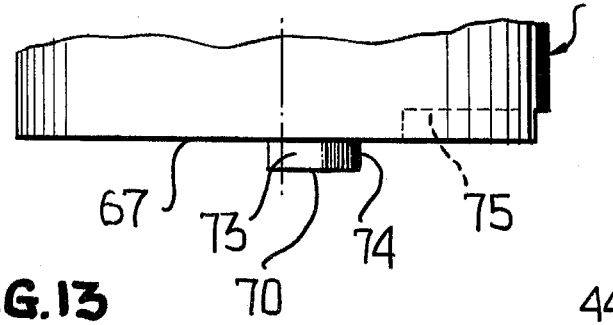
FIG. 13 is a fragmentary side elevational view of the punch of FIG. 12.

Reference is now made to FIGS. 12 and 13 wherein still a further punch 65 is illustrated. The punch 65 is similar to the punch 50 and includes a main portion 66 which is circular in cross section and which terminates in a flat end face 67. The end face 67 has a center 68 which is intended to be aligned with the rivet 18 when the punch is engaged with the container end unit to effect doming thereof. The end face 67 has projecting downwardly therefrom a projection 70 which is symmetrical about a transverse line 71 extending through the center 68. While the projection is primarily disposed to the right of the center 68, a small portion thereof extends to the left. The projection 70 has a straight line edge 72 which is disposed normal to the transverse line 71. The projection 70 also has two side edge portions 73 which are concavely arcuate. A final side 74 extends transversely of the line 71 and is remote from the side 72. The side 74 is convexly arcuate.

The end face 67 is also provided with a notch 75 which corresponds to the notch 43 for receiving a projection which may exist on the undersurface of the end unit defining a recess in alignment with the lift end of the pull tab 17.

The punch 65 is used in conjunction with the punch 44 in the manner described above with respect to FIG. 11 and while the shape of the highest domed area of the resultant dome is slightly different from that produced with the punches 31 and 50, the resultant doming is effective for the intended purpose.

Although only a preferred embodiment of the doming and apparatus for forming the same has been specifically illustrated and described herein, it is to be understood that minor variations may be made in the doming tooling without departing from the spirit and scope of the invention as defined by the appended claims.

I claim:

1. In an easy opening container panel, scoring defining a displaceable panel portion, an integral upstanding rivet disposed adjacent said scoring for mounting a tab in a position to exert an opening force on said displaceable panel portion; said panel being domed in the area of said rivet to displace said rivet upwardly out of the general plane of said panel, the resultant dome including a full height dome part remote from said scoring and said dome gradually sloping back to the original plane of said panel in the area of said scoring.

2. The container panel of claim 1 wherein said full height dome part is flat.

3. The container panel of claim 1 wherein said full height dome part is flat and generally semicircular in outline.

4. The container panel of claim 1 wherein said full dome part is flat and generally semicircular in outline, and said sloping dome part is also generally flat.

5. The container panel of claim 1 together with a tab seated on said dome and secured in place by said rivet.

6. The container panel of claim 5 wherein said container panel is part of a vacuum pack container and said panel is bowed into the interior of said container in the area of said rivet, and said tab has a lifting end and a force applying end spaced from said panel for initial free movement of said tab.

7. The container panel of claim 1 wherein said panel is an end panel.

* * * * *